United States Patent [19]

Schotten

[11] Patent Number: 4,587,960

[45] Date of Patent: May 13, 1986

[54] PASSIVE LEG EXERCISE APPARATUS

[75] Inventor: Theodor Schotten, Grevenbroich, Fed. Rep. of Germany

[73] Assignee: Firma Neubauer GmbH, Mashinenbau, Neuss, Fed. Rep. of Germany

[21] Appl. No.: 502,707

[22] Filed: Jun. 9, 1983

[30] Foreign Application Priority Data

Jun. 10, 1982 [EP] European Pat. Off. ..... 82105086.1

[51] Int. Cl.[4] ..... A63B 69/16; A61H 1/02

[52] U.S. Cl. ..... 128/25 R; 272/73

[58] Field of Search ..... 128/25 R, 24 R; 272/73; D21/194; 74/594.4

[56] References Cited

U.S. PATENT DOCUMENTS

| | | | |
|---|---|---|---|
| D. 257,515 | 11/1980 | Faux | D21/194 |
| 2,206,902 | 7/1940 | Kost | 128/25 R |
| 2,616,416 | 11/1952 | Gillmeier | 128/25 R |
| 3,057,201 | 10/1962 | Jaeger | 272/73 |
| 3,207,512 | 9/1965 | Kinsey | 272/118 X |
| 3,216,722 | 11/1965 | Odom | 128/25 R |
| 3,991,749 | 11/1976 | Zent | 128/25 R |
| 4,305,578 | 12/1981 | Disbrow | 272/73 |
| 4,378,111 | 3/1983 | Tsuchida | 272/73 |
| 4,402,502 | 9/1983 | Peters | 128/25 R X |
| 4,411,169 | 10/1983 | Takeda | 74/594.4 |

*Primary Examiner*—Richard J. Apley
*Assistant Examiner*—Kathleen D'Arrigo
*Attorney, Agent, or Firm*—Holman & Stern

[57] ABSTRACT

In an apparatus for passive leg-exercises comprising a pedal bearing which is supported by a floor stand and a pedal crank with pedals driven by a driving motor, the invention provides that above the floor stand, which forms a lower apparatus section, there is an independent upper section which carries handle bars. This upper section is connected with the floor stand by a tube of flat cross sectional configuration and is inclined from the vehicle in the direction towards the user. The knees of the user are maintained relatively apart by smooth walls of the upper section. The user can operate the apparatus from a wheelchair so that it is possible to treat particularly patients suffering from illnesses such as multiple sclerosis or paralysis. The pedals are suspended and therefore allow, even where full control function is lost in the patient's feet, an optimal anatomically correct position at all times while the crank is turning.

12 Claims, 7 Drawing Figures

FIG. 3
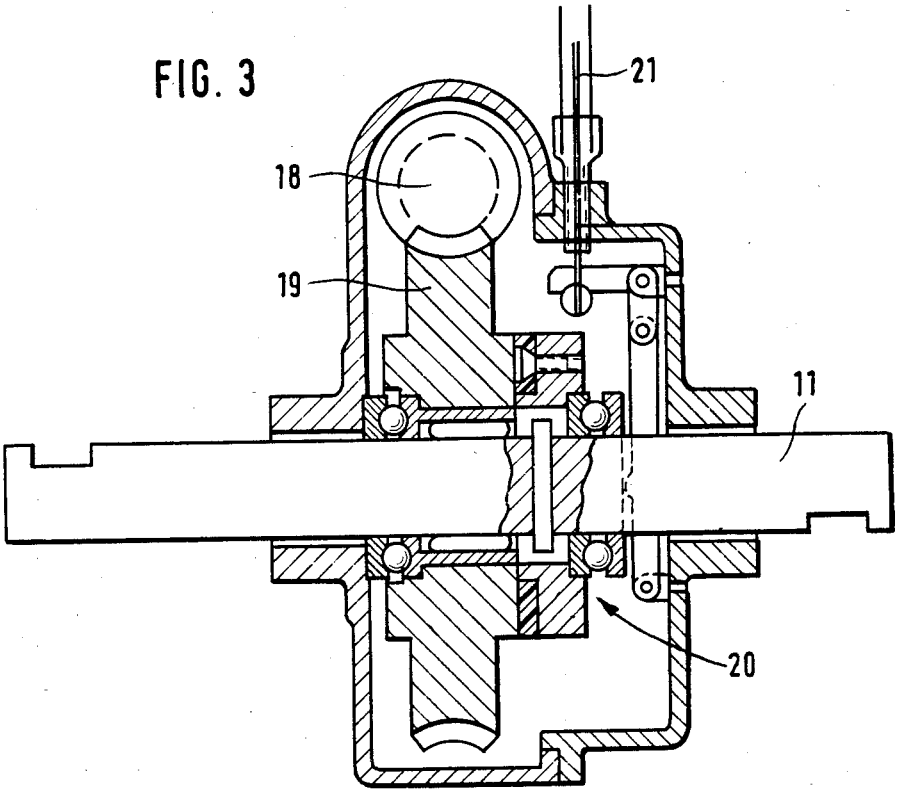
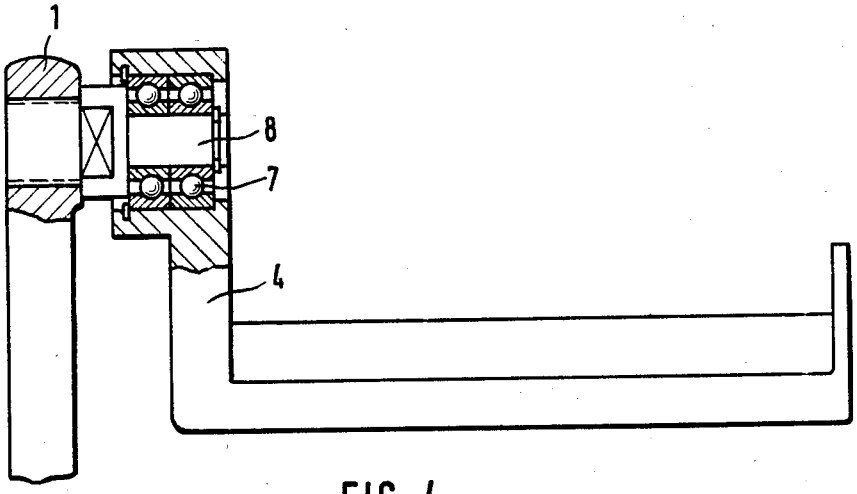
FIG. 4

PASSIVE LEG EXERCISE APPARATUS

BACKGROUND OF THE INVENTION

1. Field of the Invention

The invention relates to apparatus for passive leg-exercise of the kind comprising a pedal bearing on a floor stand, a crank with a pedal arranged on each side of the bearing and driven by an actuating motor, a handle bar at the top with gripping handles, and a body which is essentially made up of smooth panels extending in vertical planes.

2. Description of the Prior Art

Apparatus of this kind is known from U.S. Pat. No. 3,991,749. This arrangement is basically derived from the structure of a bicycle in as much as a saddle, the pedal bearing and the handle bar together form a triangle in which the handle bar, as viewed by the user of the apparatus is obliquely forwards above the pedal bearing whilst the saddle, viewed in corresponding manner is obliquely rearwards above the pedal bearing. With such an arrangement only users who are capable of sitting on a saddle and moreover have sufficient directional control over their leg movements can use the apparatus for passive leg exercise. Since with this arrangement the body-cladding slopes obliquely forwards away from the user whilst the narrow side of the cladding which faces the user must remain accessible for actuation of a switch button, there is a risk that the knees of the user, where there is inadequate control function, may knock against the edges of the cladding panels or they may even knock against each other. For this reason apparatus of this kind cannot be used by patients suffering from diseases which confine the patient to a wheelchair. With the aid of this apparatus it is not possible to produce the leg exercises which are strictly of the passive exercise type such as required for paraplegics and multiple-sclerosis sufferers.

Yet the therapeutical value of even strictly passive leg exercise is quite indisputable because it helps to delay or even completely prevent atrophying of the leg muscles. Besides this it is also possible in the healing phase following spinal injuries and leg fractures to assist and accelerate the healing process at a relatively early stage of the therapeutical treatment by application of passive leg exercises.

BRIEF SUMMARY OF THE INVENTION

It is one object of the present invention, to provide apparatus of the kind hereinbefore specified, which will enable the leg exercises to be carried out also with patients which are confined to a wheelchair, particularly patients suffering from the above mentioned diseases.

With this aim in view there is provided in accordance with the invention passive leg-exercise apparatus comprising a pedal bearing, a floor stand carrying the same, a crank with associated pedals arranged on each of the two sides of said pedal bearing, a driving motor for driving said cranks, an upper handle bar with handle grips and a body which is essentially made up of smooth panels extending in vertical planes through which said handle bar projects, characterized in that the body is constructed as an independent top section which is arranged so as to separate the knees of the user and is in spaced relationship with a lower section to which it is connected by a tube which extends from the floor stand, that its horizontal cross-section has a length which is substantially greater than its width, and is closed at the top by a top plate which is adapted to accommodate manual switches for the driving motor and which is upwardly inclined towards the user, and in that the handle grips are disposed above the pedal crank bearing.

The arrangement which is thus proposed by the present invention notably enables the pedal crank bearing as well as the handle bars being reached from a seat which is not associated with the apparatus, particularly from the seat of a wheelchair. Due to the fact that the body of the apparatus is an independent part having the new cross sectional configuration it can safely keep the knees of the user apart so that throughout the applied exercise movement the knees of the patient are securely guided along the lateral walls of this top section. Moreover, since the arrangement is obliquely slanted in the direction towards the user the latter can reach the gripping handles even without basically altering his seated position in the wheelchair.

In an attractive embodiment of the invention the top body section of the apparatus is adapted to be pivotally adjusted relative to the lower section in the direction towards the user and to be locked in the adjusted position, thus allowing extensive adaptations to be made to patients having different degrees of mobility and also to patients of different sizes. Conveniently in that case the floor stand is provided at the height of the pedal crank shaft with a gear-housing or gear-case accommodating the latter and an actuating motor flanged thereto with a pivot bearing mounted on the gear case with the aid of a set screw whereby the angle of inclination of the tube can be fixed, the tube being mounted in said bearing by means of an adjusting lever for movement about a horizontal transverse pivot axis and the set-screw being applied to the adjusting lever. Such apparatus can be adjusted by the patient himself to suit his or her individual needs and can be effortlessly operated by the patient because the gripping handles are accessible to him even when seated in his wheelchair.

Further adaptation to the needs of the patient is achieved by arranging that the top section of the body is vertically slidable and lockable relative to the lower body section, the tube being a square sectioned tube on which a larger square tube which carries the top section is telescopically engaged and adapted to be locked in position by means of a further set screw.

The cladding body consists preferably of a plastics material, particularly of polymetacrylic acid methyl ester, which allows the manufacture of a smooth panel design so as to preclude all risk of injury when the knees come into contact with the panel walls.

It was found to be very important that the pedals should be so arranged as to hang from the cranks beneath their fulcrum. This ensures at all times an optimum foot position when the crank rotates because in each and any crank position the pedals preserve an equally readily accessible tread position for the user. The actual position of the users foot will then optimally adjust itself while the crank rotates. This is very important because patients who can no longer control their leg movements generally are equally unable to control their foot movements sufficiently to find the best possible position for their feet. Thanks to the suspended pedal mounting therefore it is quite impossible for the patient's feet to tilt or to twist.

The driving motor is preferably adapted to be operated at variable speed. Conveniently, motor adjustment is obtained by means of a control arranged on a top cover plate of the upper body section. Such a plate may incidentally also accommodate a manual switch for starting the driving motor. Alternatively one of the gripping handles may also be rotatable and allow adjustments of motor speed to be made in this manner via a connecting cable.

For reasons of operational safety it is a considerable advantage if the drive is transmitted from the motor to the pedal crankshaft by means of a worm gear and a slipping clutch. In such an arrangement the user may also operate the apparatus via bowden cable from the handle bar.

According to another feature of the invention the lateral walls of the upper body section are preferably domed inwardly in the region of the user's knees. In this manner they provide particularly safe engagement surfaces if the user's knees should become turned inwards in uncontrolled movements.

In order. to enable the apparatus to be effortlessly brought to the user and taken away again after use, the floor stand is provided along its front and along its rear edge with a roller mounted in such a way that it comes into contact with the floor when the apparatus is tilted, thus enabling the apparatus to be easily pushed or rolled up to the user and away from him after use.

The stability of the new apparatus is greatly enhanced by the provision on the floor stand of front and rear struts projecting from the stand on both sides thereof and in contact with the floor.

Lastly the risk of injury to the patient during pedal movement may be still more securely avoided by providing the foot plates of the pedals with raised edge portions.

BRIEF DESCRIPTION OF THE DRAWINGS

The invention will now be more specifically described with reference to the accompanying drawings which relate to embodiments of the present invention and wherein:

FIG. 3 is a cross-sectional view of the transmission gear of the apparatus;

FIG. 4 is a partial cross-sectional view of the pedal assembly of the apparatus;

DETAILED DESCRIPTION

Figure 1:
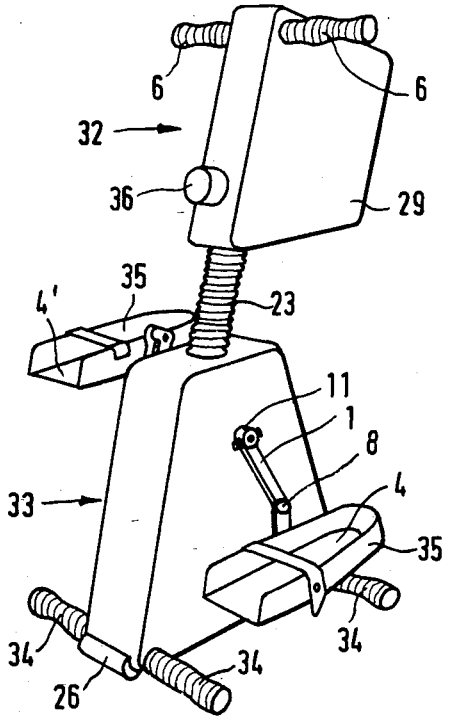
FIG. 1 is a perspective view of one example of apparatus according to this invention in oblique front elevation.
Figure 2:
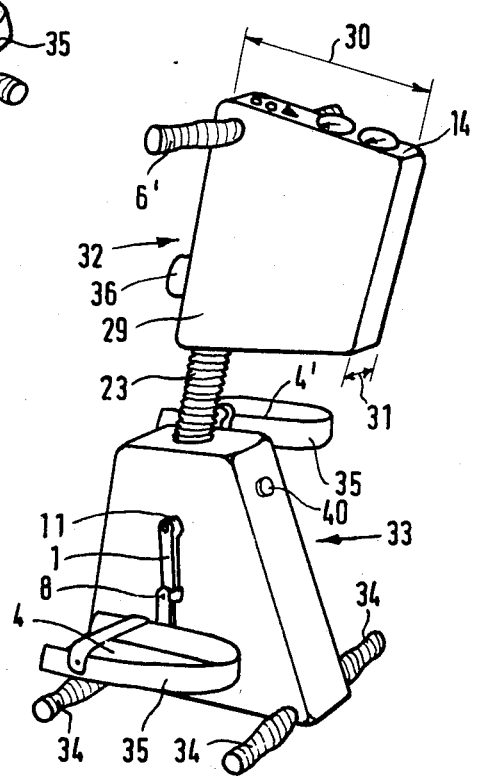
FIG. 2 is a perspective view of the apparatus in obique rear elevation.

FIGS. 1 and 2 show a pedal crankshaft 11 which projects out of lower body cladding section 33, a crank 1 being connected to the shaft 11 on each side thereof. Pedals 4, 4' are suspended from pivots 8 at the outer ends of the cranks. Within the cladding body section 33 there is further accommodated a driving motor with clutch and transmission gear which will be more particularly described later, by means of which the pedal crankshaft 11 can be rotated. The lower body section 33 is maintained firmly on the floor by means of two outrigger struts 34 which each project on both sides thereof. Along the frontal or leading edge of said section there is a roller 26 which is normally not in touch with the floor. However, when the apparatus is tilted forwards said roller 26 makes contact with the floor thereby making the apparatus more easily movable.

A tube 23 extends upwards from section 33 so as to support the upper section 32 of the cladding body in spaced relation to the lower section. This upper section is so designed, in particular, that it will produce a separation of the patient's knees. The smooth walls 29 which make up the cladding of this upper section 32 in essence also permit the knees to slide easily over these walls thereby avoiding risk of injury. The lateral walls may be domed inwardly in the region of the user's knees. This means that the length 30 of section 32 (see FIG. 2) must be of suitable dimension to ensure that section 32 will remain between the patient's knees. The width 31 of section 32 is relatively short. Gripping handles 6 and 6' project through the panels of section 32 near the frontal top edge. One of these handles is rotatable and by means of a bowden cable allows adjustment of the speed of the motor, not shown. At the top, the body section 32 is closed off by a substantially plane plate 14 which as shown in FIG. 2 may also carry switches and indicator instruments and as an alternative to arranging that one of said handles rotatable, speed control of the driving motor may be effected by a control on said top plate 14. As a rule the user will sit behind the apparatus so that, with extended arms, his hands can reach and embrace the handle grips 6, 6'. The patient's feet are placed into the pedals 4 in such a way that the toes point towards the open pedal ends. The raised marginal edge portions 35 of the pedals protect the sides of the feet and potentially also the ankles against accidental knocks.

The aforesaid pivots 8 of the cranks 1 carry, as shown in FIG. 4, radial ball bearings 7 mounted on projecting bolts, by means of which the pedals are suspended from the cranks. The pedal crank shaft 11 to which the cranks are secured at one end thereof is driven, as shown in FIG. 3, by means of a worm 18 and gearwheel 19 in mesh therewith and, lastly, by a slipping clutch 20. For the slipping clutch there is a bowden cable 21 which is conducted upwards through tube 23 so that it can be operated from the top.

It will further be seen from FIG. 3 that the whole arrangement is accommodated within a housing so that, on the one hand, transmission gear and clutch are protected against dirt and, on the other hand, that no oil or lubricant can escape to the outside.

FIG. 1 shows a set screw 36 by means of which it is possible to adjust the height of the upper body section 32 as will be hereinafter more particularly described. FIG. 2 also shows a set screw 40 by means of which the upper body section 32 can be pivotally adjusted as will also be hereinafter more specifically described.

Figure 6:
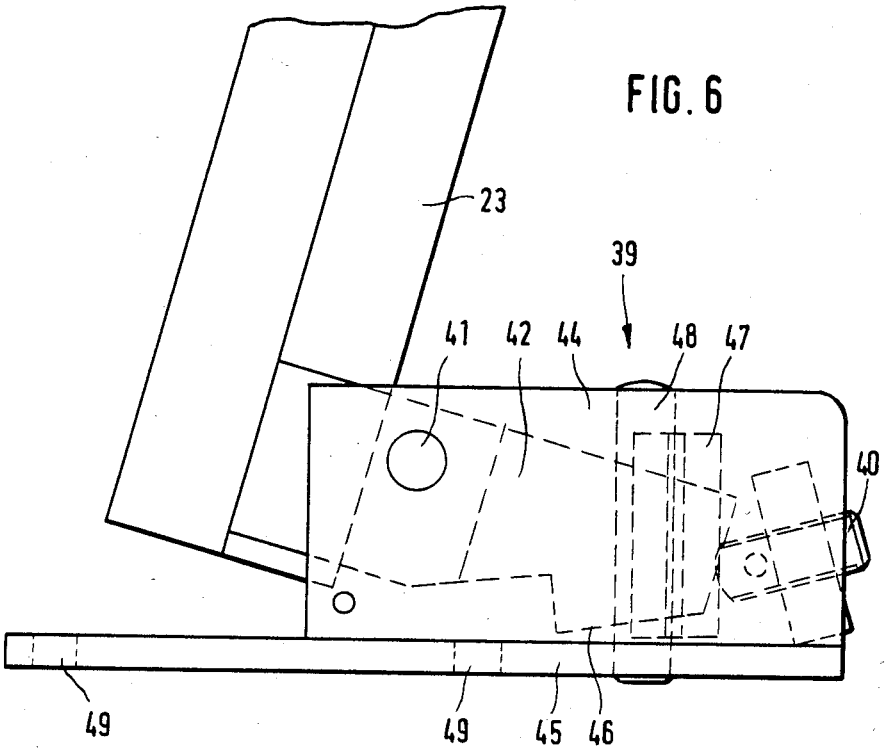
FIG. 6 is a side elevational view of the pivot bearing shown in FIG. 5.
Figure 5:
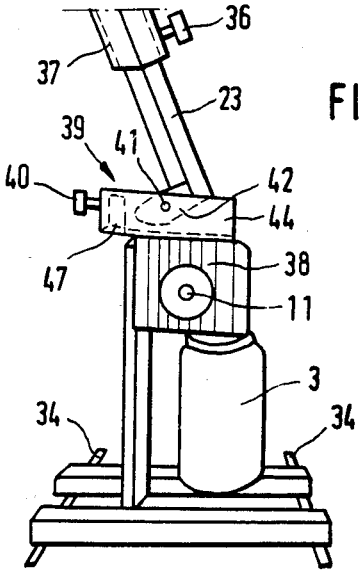
FIG. 5 is a partial perspective view of the floor stand and the lower body section of the apparatus, without the cladding.

FIG. 5 shows the floor stand and the lower region of the parts contained in the upper body section, but without the cladding. The floor stand is supported by the outrigger struts 34 and it carries a housing 38 of the above mentioned wormgear from which extends the pedal crankshaft 11. The driving motor 3 is connected to the bottom of housing 38 which latter, in the upper part, serves for the securing of a pivot bearing 39 which is more particularly shown in FIG. 6. By means of an adjusting lever 42, a square-sectioned tube 23 can be pivoted about axis 41 which is mounted between side-plates 44 of bearing 39. The adjusting lever 42 which is welded to the lower part of tube 23, tapers inside bearing 39 so that when the tube 23 is pivotally displaced within the predetermined range there will be no contact with the bottom plate 45 of the bearing. However, in the terminal position the abutment face 46 engages with this bottom plate. The adjusting lever 42 is locked or arrested by means of a flap 47 which can be pivoted about the vertical axis 48 of the bearing 39. The position of flap 47 may also be varied by means of the set screw 40. Since the center of gravity of the upper body section 32, as viewed in FIG. 6, is on the right hand side above the pivot axis 41 it will tend to maintain the upper section 32 always in its lower position so that in any position of the upper body section 32 the set screw 40 is in compression stress.

Incidentally, the pivot bearing 39 is provided with fastener holes 49 for its connection to the gear housing 38.

A larger, likewise square sectioned tube 37 is fitted over tube 23 and, as seen in FIG. 5, is adapted to be locked in position by means of the set screw 36. The larger square-sectioned tube 37 carries the upper body section 32. Thus the height position of the upper body section 32 can be individually adjusted to suit the patient by means of the set screw 36 which is also visible in FIG. 1.

Figure 7:
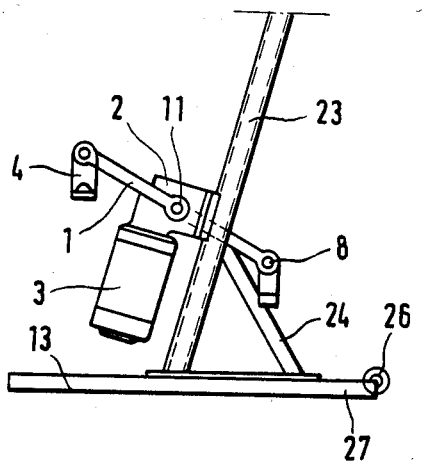
FIG. 7 is a side elevational view of the floor stand and lower body section of another embodiment according to the present invention.

The modified embodiment shown in FIG. 7 shows an upwardly extending tube 23 which together with struts 24 makes up a floor stand which in modified manner carries the pedal-crank bearing 2 and with it also a gear case to which is flanged a driving motor 3. The pedal crankshaft 11 projects out of the bearing 2 on both sides and carries the cranks 1 from which the pedals 4 are suspended. The floor plate 27 on which the floor stand is mounted is provided with a roller 26 at its rear edge. This roller extends above the bottom edge 13 of the floor plate 27 so that only when the apparatus is tilted will the roller 26 come into contact with the floor and then allow the apparatus to be wheeled into and out of position.

I claim:

1. A passive leg-exercise apparatus comprising:

a lower body section comprising:

a floor stand, a pedal bearing means supported on said floor stand, a pedal crank rotatably mounted in said pedal bearing means and extending outwardly beyond the ends thereof, a pedal pivotally mounted on each outer end of said pedal crank so that the pivot axis of each pedal is always above the pedal in use, a drive motor supported on said floor, and means to operatively connect said drive motor to said pedal crank to rotatably drive said pedal crank;

a tubular support mounted on said floor stand extending upwardly therefrom at an inclined angle;

an independent upper body section supported on the upper portion of said tubular support in spaced relationship above said lower body section comprising:

smooth side panels extending in spaced substantially vertical planes, a top plate closing the top of said upper body section, manual control means mounted on said top plate operatively connected to said drive motor for controlling the operation thereof, a handlebar projecting through said side panels, handle grips on the outer ends of said handlebar disposed above said pedal bearing means, the horizontal length of said side panels being substantially greater than the spacing between said side panels and said side panels being arranged with respect to said pedals so that in use said upper body section separates the knees of a user when the feet of the user are in said pedals;

means to pivotally move said upper body section about a horizontal transverse axis relative to said lower body section; and means to lock said upper body section in position.

2. Apparatus as claiemd in claim 1 further comprising:

a drive housing mounted on said floor stand, and wherein;

said drive motor is mounted on said drive housing, said means to pivotally move said upper body section comprises a horizontal pivot bearing mounted on said drive housing, an adjusting lever extending from the lower end of said tubular support pivotally mounted on said pivot bearing for pivotal movement about said horizontal transverse axis, and said means to lock said upper body section comprises a set screw operatively mounted in said drive housing in engagement with said adjusting lever.

3. Apparatus as claimed in claim 2 wherein:

said tubular support comprises a lower tube member having a square cross-section and an upper tube member having a larger square cross-section telescopically engaging said lower tube member so that said upper body section is vertically adjustable relative to said lower body section; and a set screw is threadedly engaged in said upper tube member and operatively engages said lower tube member to lock said tube members together in any adjusted position.

4. Apparatus as claimed in claim 3 wherein:

each pedal comprises a footplate having raised peripheral edge portions.

5. Apparatus as claimed in claim 4 wherein:

said pedal crank comprises a crank shaft mounted in said pedal bearing for rotation about a horizontal axis and crank arms non-rotatably mounted on the outer ends of said crank shaft and extending at substantially right angles to the axis of rotation thereof;

each footplate has an upwardly extending member;

a footplate bearing is provided in the upper portion of said upwardly extending member; and the outer end of each crank arm is rotatably mounted in a respective footplate bearing.

6. Apparatus as claimed in claim 1 wherein:

said tubular support comprises a lower tube member having a square cross-section and an upper tube member having a larger square cross-section telescopically engaging said lower tube member so that said upper body section is vertically adjustable relative to said lower body section; and a set screw is threadedly engaged in said upper tube member and operatively engages said lower tube member to lock said tube members together in any adjusted position.

7. Apparatus as claimed in claim 1 wherein:

said drive motor is operable at variable speed; and said manual control means adjusts the speed of the drive motor.

8. Apparatus as claimed in claim 7 wherein:

said manual control means comprises a handle grip rotatably mounted on said top plate.

9. Apparatus as claimed in claim 1 and further comprising:

a roller rotatably mounted on said floor stand adjacent to the bottom thereof so that upon tilting of said floor stand said roller contacts the floor.

10. Apparatus as claimed in claim 1 wherein:

said floor stand is provided on both sides with laterally projecting outrigger struts for contacting the floor to prevent tipping of the apparatus in use.

11. Apparatus as claimed in claim 1 wherein:

each pedal comprises a footplate having raised peripheral edge portions.

12. Apparatus as claimed in claim 11 wherein:

said pedal crank comprises a crank shaft mounted in said pedal bearing for rotation about a horizontal axis and crank arms non-rotatably mounted on the outer ends of said crank shaft and extending at substantially right angles to the axis of rotation thereof;

each footplate has an upwardly extending member;

a footplate bearing is provided in the upper portion of said upwardly extending member; and the outer end of each crank arm is rotatably mounted in a respective footplate bearing.

* * * * *